United States Patent [19]

Stumpf

[11] Patent Number: 4,915,063

[45] Date of Patent: Apr. 10, 1990

[54] VAPOR LOCK PREVENTION SYSTEM

[75] Inventor: Marvin D. Stumpf, St. Paul, Minn.

[73] Assignee: Tilton Equipment Company, St. Paul, Minn.

[21] Appl. No.: 355,031

[22] Filed: May 16, 1989

Related U.S. Application Data

[63] Continuation of Ser. No. 918,371, Oct. 14, 1986, abandoned, which is a continuation-in-part of Ser. No. 787,631, Oct. 15, 1985, abandoned.

[51] Int. Cl.[4] ..... F02B 77/00

[52] U.S. Cl. ..... 123/41.31; 123/195 A; 123/509; 261/DIG. 68

[58] Field of Search ..... 123/41.31, 495, 507, 123/508, 509, 516, 41.65; 261/DIG. 68; 417/395, 418

[56] References Cited

U.S. PATENT DOCUMENTS

| | | | |
|---|---|---|---|
| 2,120,779 | 6/1938 | Ericson | 123/170 |
| 2,791,186 | 5/1957 | Alden | 103/150 |
| 2,796,057 | 6/1957 | Dolza | 123/509 |
| 2,834,469 | 5/1958 | Mitterer | 210/181 |
| 2,984,188 | 5/1961 | Tuckey et al. | 261/DIG. 68 X |
| 3,090,608 | 5/1963 | Phillips | 261/DIG. 68 |
| 3,179,055 | 4/1965 | Kalert | 261/DIG. 68 X |
| 3,256,869 | 6/1966 | Nutten et al. | 261/DIG. 68 X |
| 3,262,433 | 7/1966 | Jordan | 261/DIG. 68 X |
| 3,272,485 | 9/1966 | Newman | 261/DIG. 68 X |
| 3,332,476 | 7/1967 | McDougal | 165/51 |
| 3,368,495 | 2/1968 | Turner | 103/152 |
| 3,800,770 | 4/1974 | Baribeau et al. | 123/495 |
| 3,967,606 | 7/1976 | Perry | 123/139 AJ |
| 3,987,774 | 10/1976 | Waag | 123/495 |
| 4,072,138 | 2/1978 | Hawkins | 123/122 E |
| 4,084,564 | 4/1978 | Rickert | 123/139 AV |
| 4,098,251 | 7/1978 | Scott | 123/195 A |
| 4,124,008 | 11/1978 | Fujikawa | 123/495 |
| 4,308,827 | 1/1982 | Roe | 123/541 |
| 4,494,490 | 1/1985 | Kiyooka et al. | 123/41.65 |
| 4,539,945 | 9/1985 | Bosisio | 123/41.31 |
| 4,597,371 | 7/1986 | Wissmann et al. | 123/495 |
| 4,653,762 | 3/1987 | Nakamura et al. | 123/495 |

FOREIGN PATENT DOCUMENTS

| | | | |
|---|---|---|---|
| 148958 | 11/1980 | Japan | 123/509 |
| 885152 | 12/1961 | United Kingdom | 123/41.31 |

*Primary Examiner*—Noah P. Kamen

*Attorney, Agent, or Firm*—Kinney & Lange

[57] ABSTRACT

An apparatus for reducing or eliminating the occurrence of vapor lock in two-cycle engines isolates the fuel pump from the heat radiating engine block in a two-cycle, air cooled engine spaces the fuel pump from the carburetor and injects the fuel directly against the carburetor inlet valve. Application of an additional cooling means including airflow and liquid fuel means, may be provided in order to convey heat away from the fuel pump and therefore maintain the fuel pump temperature below the point at which vaporation pressure exceeds the impulse pressure generated from the power head. The fuel pump is removed from the hot carburetor as part of the vapor lock prevention system.

1 Claim, 3 Drawing Sheets

VAPOR LOCK PREVENTION SYSTEM

CROSS REFERENCE TO RELATED APPLICATION

This application is a continuation of Ser. No. 918,371, filed Oct. 14, 1986 (now abandoned) which in turn is a continuation-in-part of my copending application Ser. No. 06/787,631, filed Oct. 15, 1985 for Vapor Lock Prevention Device now abandoned.

BACKGROUND OF THE INVENTION

1. Field of the Invention.

This invention relates to a device for preventing the formation of vapor lock in two-cycle engines.

2. Description of the Prior Art.

Vapor lock is a commonly encountered problem in two-cycle engines. Vapor lock occurs when fuel is inhibited from passing through the fuel line to the engine due to the presence of vaporized fuel in the fuel pump and along the fuel line. When vapor lock occurs the engine is fuel stained and will not run. Vaporization is caused by high temperatures around the fuel pump and fuel line which can result from heat migrating from the cylinders of the engine.

Numerous devices have been disclosed which are designed to maintain a reduced temperature about fuel lines in order to prevent the formation of a vapor lock. For example, U.S. Pat. No. 4,072,138 to Hawkins discloses a fuel systems having a heater mounted between the carburetor and the fuel pump. The heater is operated by circulating hot water from the engine block through the heater which is positioned next to the fuel line. To prevent vapor lock, a cooler is provided between the fuel pump and the heater. The cooler is operated by passing the fuel line in front of the radiator and exposing it to air currents passing to the radiator.

Another method for reducing the temperature of the fuel in the fuel system is disclosed by U.S. Pat. No. 3,332,476 to McDougal. The device is designed to dissipate heat from the intake manifold by circulating vaporized liquid through an evaporater which is positioned next to the fuel line. The liquid in the evaporater absorbs the heat within the fuel line and vaporizes. The vapor is then transported to a cooler region in the engine where it is condensed and returned to the evaporater.

Evaporization of water has also been used to reduce the temperature of the fuel within the fuel system. U.S. Pat. No. 2,791,186 to Alden discloses a water jacket which is mounted about the fuel pump chamber. The water jacket is constructed of a porous metal surface which is kept wet through the use of a water reservoir and feed line. The nature of the porous surface permits water vapor to easily evaporate therefrom after absorbing heat from the pump chamber, thus reducing the temperature within the fuel system. Similarly, U.S. Pat. No. 2,120,779 to Ericson utilizes a cooler having a comparable porous surface which is fed by a water reservoir. The Ericson device is designed to evaporate water quickly by mounting the cooler in the direct path of the fan blast and away from heated parts of the engine, such as the exhaust manifold. Both the Alden and Ericson devices require the replenishment of water within the reservoir in order to operate over an extended period of time.

A variation of the water cooled fuel systems is disclosed by U.S. Pat. No. 4,084,564 to Rickert. The Rickert device uses a fuel circulating system which cools the fuel line through the use of a heat conveying tube. Cooler fuel from the fuel tank is circulated through the heat conveying tube which is positioned next to the fuel system. The heat conveying tube is constructed of heat conductive material which permits the fuel within the fuel system to be cooled by the fuel within the heat conveying tube.

Cooling ribs are provided in U.S. Pat. No. 2,834,469 to Mitterer for condensing vaporized fuel within the fuel line. The cooling ribs are mounted within a Venturi tube which is directly attached to the fuel line. As fuel passes through the fuel line, vaporized fuel passes into the Venturi tube where the cooling ribs cause it to condense. The condensed fuel is then returned in a liquid state within the fuel line at a lower temperature.

The devices previously disclosed for reducing the occurrence of vapor lock in two-cycle engines are relatively expansive, requiring extensive tubing and support structure to carry cooling fluid throughout the fuel delivery system.

The present invention provides several desireable features not found in the prior art, for example, it is simple and inexpensive. The fuel pump is thermally isolated (spaced) from the heat producing and heat transfer areas of the engine, including the carburetor. The fuel pump, which still is operated by conventional mechanical or impulse means, preferably is placed in the cool incoming airflow generated by the flywheel fan. This cool air acts as an additional thermally isolating layer over the fuel pump. Additional cooling means may be provided by placing the fuel pump in the fuel tank such that the fuel pump is thermally isolated from the heat providing areas of the engine.

The use of isolating materials in the fuel pump mounting strap prevent heat migration from the hot cylinder of the engine. As an added feature, isolation of the fuel pump allows for a larger, more effective air filter to be used, resulting in longer engine life and lower operating noise levels.

SUMMARY OF THE INVENTION

The present invention relates to prevention of vapor lock in two-cycle, air cooled engines which have a fuel tank, a carburetor, and a fuel pump, all interconnected by a fuel line, by substantially thermally isolating (spacing) the fuel pump from the engine to prevent heat migration to the fuel pump from the heat producing and radiating parts of the engine and also providing auxillary cooling. The fuel pump can be located such that it is cooled by airflow from the engine cooling fan in the vicinity of the engine. The fuel pump is preferably connected to directly inject gasoline into the passageway leading to the fuel flow control valve of the carburetor.

In one embodiment, the fuel pump is placed in the airflow produced by a fan on the flywheel. The fuel pump is physically spaced from the engine and mounted using a mount comprised of low heat conductivity or heat insulating materials which further prevent heat migration. Narrow mounting straps reduce heat transfer and strong plastic materials used for such straps are good thermal isolators.

In a further embodiment, the fuel pump is mounted in the fuel tank and liquid fuel acts as the cooling means. The fuel pump is then thermally isolated. The fuel pump is further cooled as fuel is added to the system to replace the fuel used during operation. The vapor lock prevention system further preferably replaces the conventional fuel pump mounted conventionally on the carburetor.

DETAILED DESCRIPTION OF THE PREFERRED EMBODIMENTS

Figure 1:
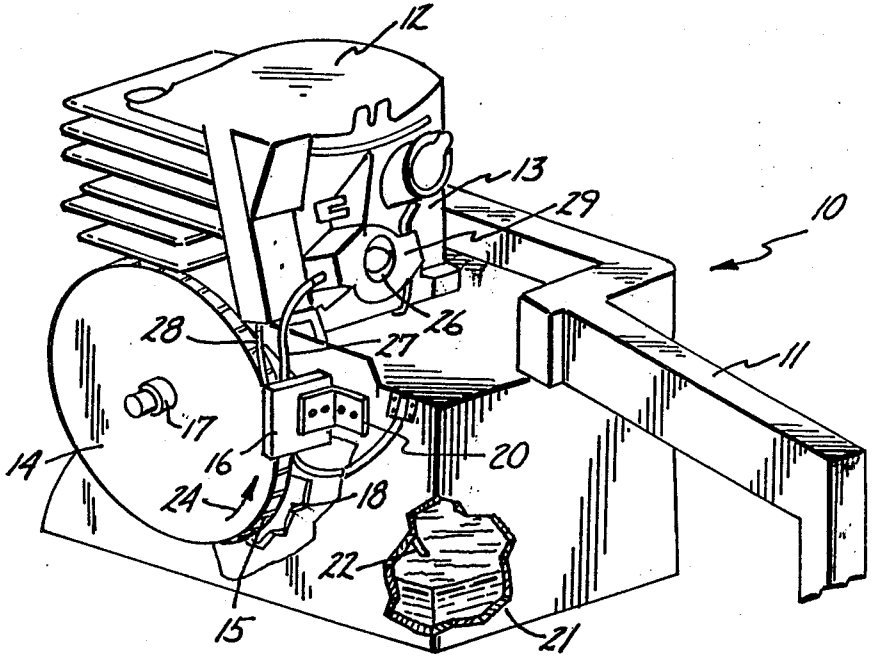
FIG. 1 is a fragmentary perspective schematic view of a two-cycle engine having a fuel pump mounted in accordance with the present invention.

Referring first to FIG. 1 of the drawing, a two-cycle 10 of conventional design, for example a two-cycle engine used in a chainsaw or similar device, for example a brush cutter having a frame 11. The engine 10 is a single cylinder, carbureted engine of any suitable design having an air cooled head 12 of conventional design that is finned to conduct and dissipate heat, and an engine block 13. The engine 10 is shown only schematically. Flywheel 14 having fan blades shown at 15 is attached to a crankshaft 17 and provides cooling air through shrouding (not shown) to the engine head, conventionally. As shown herein schematically, the fan blades are open on one side and ducting 18 (which is broken away to show the fan blades) is used to direct airflow in a flow path across a fuel pump 16 of suitable design. The fuel pump 16 is attached to the frame 11, or block 12 of the engine with a heat isolating bracket 20. The bracket 20 may be made of low heat conductivity material (such as plastics) or a heat insulation layer may be placed between the bracket and the engine to prevent engine heat from being conducted to the bracket and fuel pump.

A fuel tank 21 is supported on the block 13 or frame 11 in a suitable manner. A fuel line 22 is connected to the input side of fuel pump 16 and the output side of the fuel pump 16 is connected to a carburetor 26. The fuel pump 16 and carburetor 26 are of conventional construction and in the present system perform the standard functions of supplying desired quantities of liquid fuel, usually gasoline, to engine 10. During operation the fuel pump is driven in any desired manner, and for ease of mounting may be impulse actuated from pneumatic impulses from the engine. Flywheel 14 also may be and illustratively is of conventional design and construction. The fan blades 15 generate airflow indicated by arrow 24 for cooling the fuel pump 16 by passing the air over the fuel pump 16. The fuel pump 16 is spaced from the engine block so air flows around the pump and with the heat isolating bracket 20 reducing or preventing conduction of heat to the pump, vapor lock is not a problem. Portions of the intake fuel line 22 also is in the airflow for cooling.

The airflow is, of course, generated at all times during the operation of engine 10. Air flow also is present to the air intake of the carburetor 26 through an intake air filter (not shown).

Figure 2:
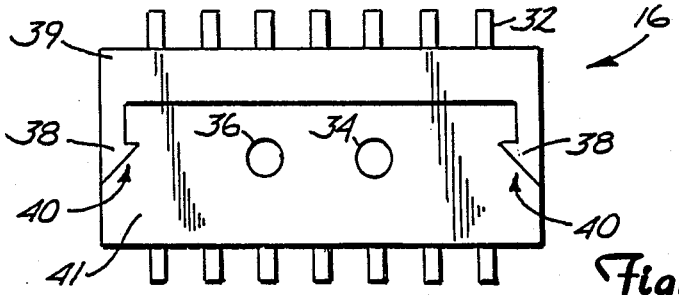
FIG. 2 is an end view of the fuel pump.

Referring now also to FIG. 2, fuel pump 16, as shown is formed of two inter-locking halves 39 and 40 that have snap lock joining members. One half 39 has longitudinal locking ribs 38 which have edge parts that fit into and can be snapped into locking grooves 40 located on the other half 41. The ribs and groove together hold the two halves 39 and 41 of the fuel pump in place. Fuel intake port 34 and an actuation impulse port 36 (for standard impulse actuation from engine 10) are located along one edge of the fuel pump (illustratively shown on top in FIG. 2 and on the bottom in FIG. 1). Fuel intake port 34 is attached to fuel line 22 which extends into fuel tank 21 to draw fuel into fuel pump 16. Attached to an impulse port 36 is impulse line 28 (FIG. 1) which communicates the engine generated impulse to the fuel pump for operating it. The fuel pump 16 can additionally be operated by mechanical means if desired. A fuel outlet is attached to fuel line 27 for supplying fuel to carburetor 26.

Cooling ribs 32 are located along the sides of the fuel pump 16 and extend outwardly therefrom. The cooling ribs increase the surface area that comes into contact with the airflow shown by arrow 24 and thereby promote greater heat transfer away from the fuel pump 16. The airflow also provides a layer of air surrounding the fuel pump 16 to help insulate it from convection heat from the heat radiating parts of the engine.

Figure 4:
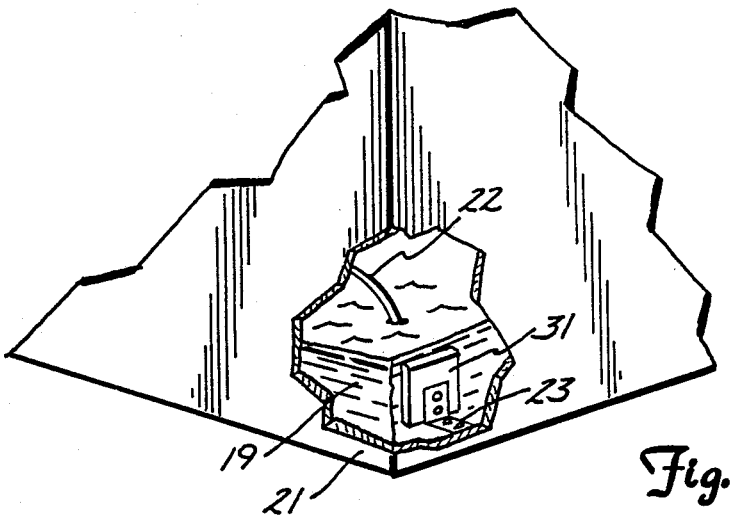
FIG. 4 is a fragmentary perspective view of a fuel pump mounted in a fuel tank for heat isolation and cooling.

Referring now to FIG. 4, a fuel pump 31 may also be and illustratively is located inside of fuel tank 21 which is supported on engine block 13. Fuel pump 31 is thermally isolated from the engine by being spaced from the engine block. The fuel pump 31 is supported in fuel tank 21 by mounting bracket 23. A liquid fuel bath 19 surrounds fuel pump 31 and partially surrounds fuel line 22 and maintains both at a temperature lower than the vaporization point. This design is especially useful in preventing vapor lock during short shut-down periods. New fillings of fuel 19 during operation of engine 10 also act to prevent vapor lock. The isolation of the fuel pump in a two-cycle engine reduces problems from heat migration and aids in reducing vapor lock.

Figure 3:
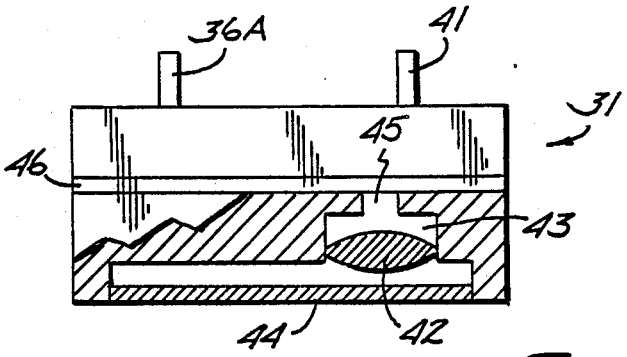
FIG. 3 is an enlarged side axial view, partially broken away to better disclose details of construction, of the fuel pump, in association with the fuel filter means and diaphragm set.

FIG. 3, the fuel pump 31 is illustratively shown and includes a primary fuel filter 44 that is open to fuel 19 and the first intake. An parteum passageway 43 has a secondary fuel filter 42 in it for eliminating foreign particles from the fuel which is drawn into the fuel pump. The passage 43 leads to the pump outlet shown at 45 that connects to line 27. The fuel pump also includes a diaphragm set 46 which acts to pump the fuel to the engine 10 through line 27 when impulses are received from the engine through impulse connection 34A.

The air filter that attaches to carburetor 26 mounts on surface 29, is not shown, but the isolation fuel pump opens up space for permitting a larger air filter to be used.

Figure 5:
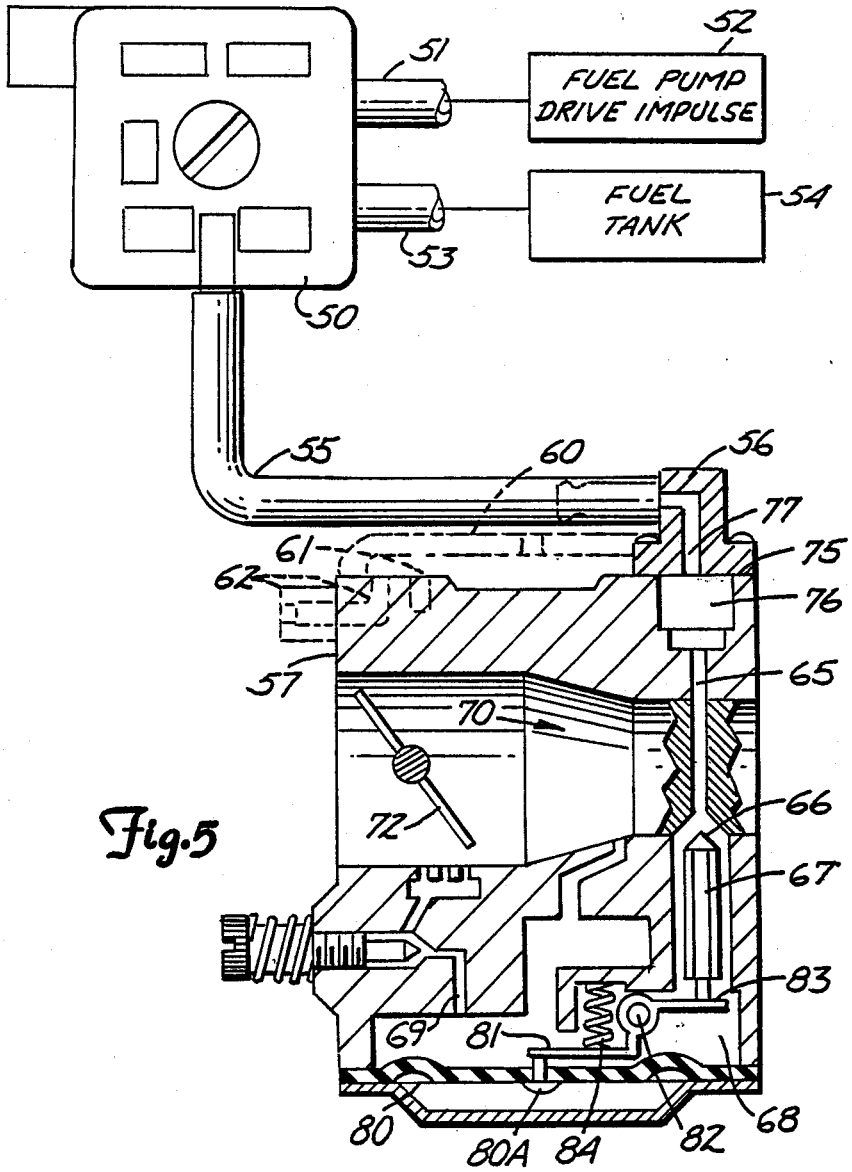
FIG. 5 is a schematic representation of a vapor lock system that eliminates problems caused by mounting the fuel pump directly on the carburetor.
Figure 5:
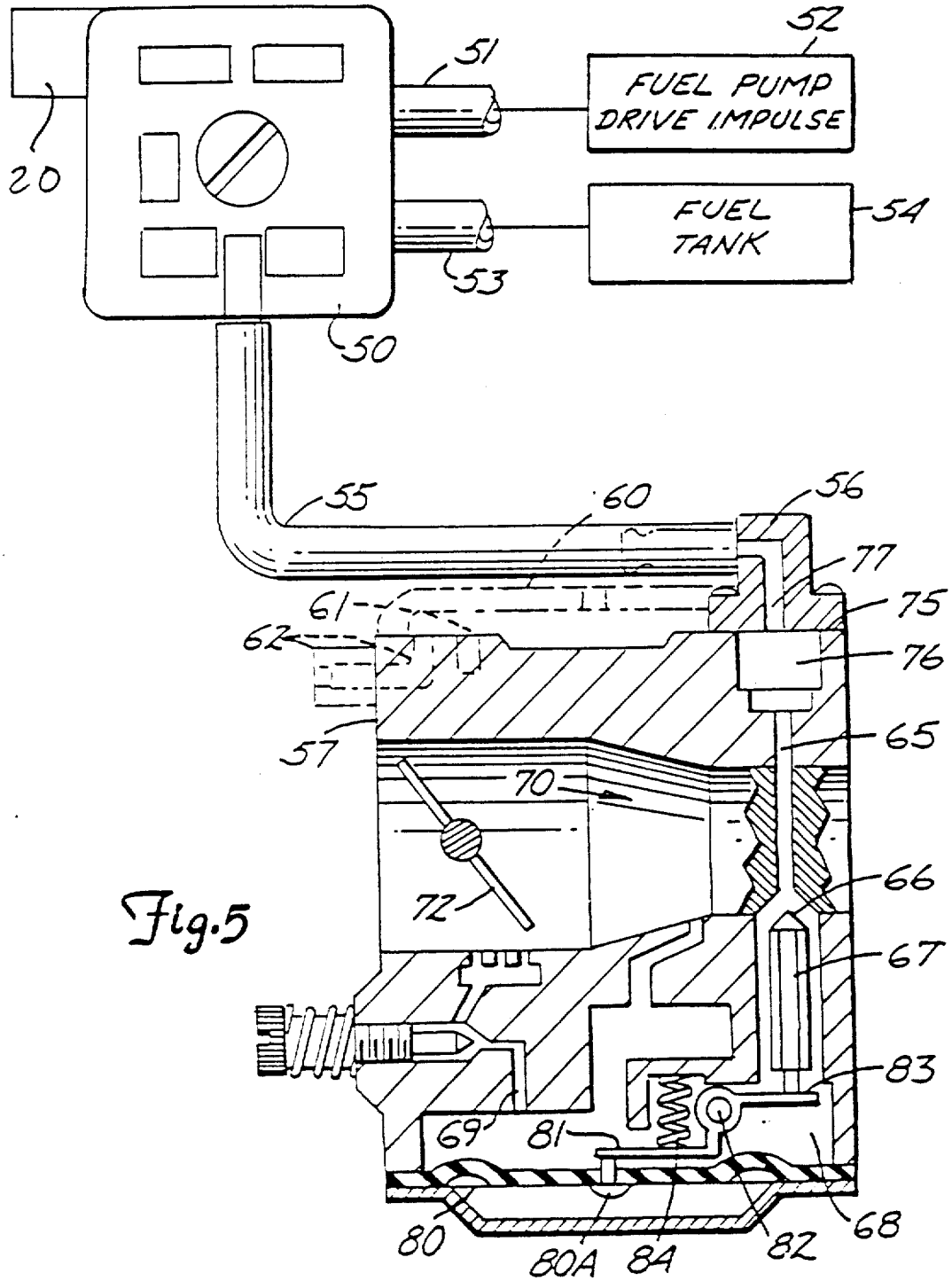

Referring to FIG. 5, a further embodiment showing a system for reducing vapor lock of a typical chain saw or brush cutter carburetor is illustrated. In this form of the invention, the fuel pump 50 is remotely located from the carburetor indicated generally at 57, and as shown, the fuel pump has an impulse inlet 51 to receive a drive impulse from a fuel pump drive 52 that is part of the two cycle engine for a chain saw or brush cutter that is being used. An inlet line 53 to the fuel pump extends from a fuel tank 54. The outlet of the fuel pump 50 is connected by a fuel line 55, that carries fuel on its interior passageway to a fitting 56 mounted onto the top of the carburetor 57.

Carburetor 57 is a typical carburetor used on two cycle engines, and in many two cycle engines, the fuel pump is normally mounted directly on top of the carburetor as represented by the dotted lines 60, and this provides a chamber 61 in which fuel is stored. The fuel inlet passageways, shown at 62 in dotted lines in the carburetor lead to this chamber. The chamber provides a vapor lock area or region from the fuel inlet because the pressure in the chamber gets high enough to prevent the fuel pump from injecting fuel. The typical carburetor also has a body that includes a carburetor inlet passageway 65 that is to the side of the chamber shown at 61. The inlet passageway passes through an inlet valve seat 66 controlled by an inlet valve 67 of conventional design that provides fuel to the metering chamber 68 and which valve controls the supply of fuel to the metering chamber. Suitable passageways shown at 69 of conventional design lead to a Venturi 70 and airflow through the venturi 70 is controlled by the butterfly or throttle valve 72.

The inlet passageway 65 has an enlarged bore 76 at the upper end thereof, opening to an upper surface 75 of the carburetor on which the normal fuel pump shown on dotted lines at 60 would mount.

The fuel pump is removed in the system of FIG. 5, and the fitting 56 is mounted on the carburetor with suitable screws and gaskets, so that an inlet passageway 77 of the fitting 56 opens directly to the bore or chamber 76 and thus directly to the inlet passageway 65, so that the fuel being injected by the fuel pump 50 through the line 55 ejects directly into the carburetor inlet passageway 65 against the inlet valve 67. The fuel is not held in a hot chamber where vapor pressure can rise and cause vapor lock, but rather is supplied under pressure directly to the inlet valve.

The inlet passageway, inlet valve and other parts of the carburetor are all conventional carburetor construction, and thus are not shown or discussed in great detail.

It is to be noted that the carburetor 57 is a pressure actuated carburetor used where engines must be operated on their sides or inverted, as opposed to a float actuated carburetor. The pressure actuation occurs by reduction of pressure in the venturi which causes a diaphragm 80 to be drawn upwardly because of reduced pressure in metering chamber 68. An actuator button 80A will operate against a pivoting bell crank lever 81 that is pivoted as at 82 and which has a tang 83 that operates against inlet valve 67. The valve 67 will be permitted to move away from seat 66 as the pressure in metering chamber 68 reduces.

A spring 84 urges bellcrank 81 to pivot to close valve 67 when the venturi pressure increases to close to atmospheric pressure.

This operation is significantly different than a float operated carburetor, but is conventional for two cycle engine carburetors.

Thus, the vapor lock prevention system shown in FIG. 5 capitalizes on use of the remote fuel pump in a two cycle engine, such as that used on a chain saw or brush cutter where the temperature becomes quite high because of heavy duty and continuous use, and eliminates any substantial volume chamber at the top of the carburetor where excessive heat can be present. In conventional systems the pressure in the fuel pump chamber represented at 61 becomes so great that it overcomes the impulse force from the power head that drives the fuel pump, namely the fuel pump drive 52.

In the present invention the fuel is directly injected from an external, remotely located fuel pump directly to the fuel inlet valve of a pressure operated carburetor. Thus the system eliminates fuel in chambers such as the normal hot fuel pump chamber on the top of the carburetor. The only fuel of any volume in the carburetor is in the metering chamber, shown at 68, which is vented to the Venturi.

The flow control used is the fuel inlet valve that operates in a normal manner for a pressure operated carburetor.

Thus, the overall system is greatly enhanced by having the remote fuel pump that can be kept cool, and out of the direct heat associated with the carburetors in the two cycle engines used for chain saws and other similar cutting such as brush cutters where high heats are common.

The system shown in FIG. 5 is available as a kit installation on existing carburetors, and the kit comprises the fitting 56 and the fuel pump 50 for remote mounting along with connecting lines, so that removing the standard fuel pump from the existing carburetor plugging the normal fuel inlet passageways in the carburetor body shown in dotted lines at 62 with epoxy or other filler, placing the fitting 56 on the carburetor to directly inject fuel from a remote fuel pump into the fuel inlet, and through the fuel valve to the metering chamber of the carburetor, is all that is required. The fuel pump includes a bracket for mounting the fuel pump remote from the carburetor as shown at 20 in FIGS. 1–4 and in FIG. 5.

The arrangement is low cost and effective. It also is simple to use on new engines or as a retrofit kit comprising a bracket of low heat conductivity and a fuel pump. The bracket will position the fuel pump in an air flow or other cooling means, including convection cooling from the surrounding atmosphere if attached away from the air flow.

The fuel metering (needle and seat) can also be combined with the fuel pump in a remote area leaving only the atomization component (carburetor venturi) and throttle attached to the cylinder.

Although the present invention has been described with reference to preferred embodiments, workers skilled in the art will recognize that changes may be made in form and detail without departing from the spirit and scope of the invention.

What is claimed is:

1. A kit for converting engine power operated carburetors used on engines on chain saws and brush cutters to a system preventing vapor lock, wherein the carburetor has a conventional fuel pump mounted on a mounting surface of the carburetor, which surface has an inlet passageway and a fuel inlet valve in the carburetor inlet passageway, comprising:

surface adapted to mount on the carburetor surface when the conventional fuel pump is removed, the fitting having an unobstructed passageway with one end aligning with the inlet passageway on the carburetor when mounted on the mounting surface and having means to receive a fuel inlet line at its opposite end;

a separate fuel pump assembly having a bracket for mounting the fuel pump at a location remote from a carburetor on which the fitting is to be mounted and substantially thermally isolated from an engine on which the carburetor is mounted; and means for coupling the fuel pump to a power source for powering the fuel pump, and line means for coupling an inlet of the fuel pump to a fuel tank and for coupling an outlet of the fuel pump to the opposite end of the unobstructed passageway of the fitting.

* * * * *

UNITED STATES PATENT AND TRADEMARK OFFICE

CERTIFICATE OF CORRECTION

PATENT NO. : 4,915,063

DATED : April 10, 1990

INVENTOR(S) : Marvin D. Stumpf

It is certified that error appears in the above-identified patent and that said Letters Patent is hereby corrected as shown below:

In the Drawings, delete published Fig. 5 and insert attached Fig. 5.

Column 6, line 52, delete "surface" and insert --a fitting--.

Signed and Sealed this

Third Day of September, 1991

*Attest:*

HARRY F. MANBECK, JR.

*Attesting Officer*

*Commissioner of Patents and Trademarks*